US005200035A

United States Patent [19]

Bhat et al.

[11] Patent Number: 5,200,035

[45] Date of Patent: Apr. 6, 1993

[54] HIGH UNIFORMITY FOAM FORMING

[75] Inventors: Dinesh M. Bhat, Neenah; Robert J. Marinack, Oshkosh; Bruce W. Janda, Neenah, all of Wis.

[73] Assignee: James River Corporation of Virginia, Richmond, Va.

[21] Appl. No.: 825,121

[22] Filed: Jan. 24, 1992

[51] Int. Cl.[5] ..... D21H 23/02

[52] U.S. Cl. ..... 162/101; 162/111; 162/198; 162/DIG. 11

[58] Field of Search ..... 162/101, 111, 198, DIG. 10, 162/DIG. 11, 322, 336

[56] References Cited

U.S. PATENT DOCUMENTS

| | | | |
|---|---|---|---|
| 3,716,449 | 2/1973 | Gatward et al. | 162/101 |
| 3,871,952 | 3/1975 | Robertson | 162/101 |
| 3,938,782 | 2/1976 | Robertson | 259/4 |
| 4,488,932 | 12/1984 | Eber et al. | 162/101 |
| 4,686,006 | 8/1987 | Cheshire et al. | 162/101 |
| 4,764,253 | 8/1988 | Cheshire et al. | 162/198 |

*Primary Examiner*—Peter Chin

[57] ABSTRACT

A method of foam forming of paper includes the steps of metering a controlled feed of fiber dispersed in an aqueous liquid into a dewatering device, wherein the consistency of the fiber dispersed in the aqueous liquid input to the dewatering device is between about 0.5 and about 7% by weight. A uniform continuous strand of semi-moist pulp is obtained wherein the consistency of the semi-moist pulp leaving the dewatering device is between about 8 and 30% by weight. A stream of a foamed aqueous admixture is obtained and introduced into a dispersing mixer having shearing action extending substantially throughout a zone substantially athwart the flow path of the uniform continuous strand and the foamed aqueous stream and forming a stream of dispersed fiber bearing aqueous foam. The dispersed fiber bearing aqueous stream is conducted to the inlet of a positive displacement pump. Thereafter the dispersed fiber bearing stream is conducted through a headbox and the fibers dispersed in the stream are deposited on a moving foraminous support.

28 Claims, 9 Drawing Sheets

HIGH UNIFORMITY FOAM FORMING

BACKGROUND OF THE INVENTION

1. Field of the Invention

The present invention is directed to a method of forming paper wherein the furnish is supplied to a dewatering press, and thereafter, to a repulping mixer prior to being supplied to a headbox of a papermaking machine.

2. Description of Background Art

Tissue products can be surprisingly difficult to form. It is necessary for the tissue be both soft and strong and also possess good formation or uniformity. The tissue product must be produced at very low cost implying that the process must be carried out at very high speed. Typically, tissue is formed by depositing a very thin layer of a very uniform dispersion of fiber in a carrier on a support which moves at high speed, the dispersion being referred to as the furnish and the support as the wire. Usually, the furnish is a two phase furnish of fiber dispersed in a continuous phase of water. Recently, processes employing three phase furnishes have been developed using an aqueous foam as the carrier for the fiber. However, to disperse the fiber in the foam with the required degree of uniformity and then maintain that degree of uniformity until the furnish can be deposited on the wire can be quite difficult. Further, many types of difficult-to-disperse fibers are known which could be advantageously incorporated into tissues but for the difficulty involved in dispersing them.

One approach is set forth in the Eber et al Patent, U.S. Pat. No. 4,488,932, which is commonly assigned herewith, wherein a large inventory of fiber-containing foamed furnish is maintained in a mix tank at a mix tank consistency of between about 0.3 to about 4.0% fiber by weight, preferably between 1.5 to 4.0%. An agitator provides the requisite energy to disperse the fibers rapidly, but gently such that wetting of the treated fibers is minimized. The foamed furnish of treated and untreated fibers leaves the mix tank through a line to a twin screw pump which provides the motive energy therefor. Residence time is quite low in the mix tank, typically below 5 minutes, preferably below 3 minutes, for greater retention of high bulk properties of the treated fibers. Retention of the treated fiber characteristics is furthered by the utilization of foamed liquid as the dispersing media, the bubbles in the foamed liquid apparently adhering to and forming a film on the surface of the fibers, particularly the treated fibers, thereby decreasing the potential for fiber wetting even in the presence of mild agitation.

Care is required in the design of agitator members disclosed in the Eber et al Patent. The agitator members are adapted to provide good dispersion of the fibers. Recommended agitation members are low shear agitators with multiple level axial flow impellers in a baffled tank. Variable speed agitation drives are desirable to allow adjustment to minimum mixing energy required for blending the fiber dispersion and operation at energy levels such that turbulence is minimized, yet is sufficient to adequately disperse the fibers. Turbulence is also minimized by proper design of the mix tank.

In operation, procedures using the configuration described in the Eber et al Patent have been found to provide insufficient control over basis weight of the web leading to excessive variability in product properties.

To circumvent the problems involved in producing commercially acceptable tissue using the disclosure set forth in the Eber et al Patent, a procedure described in commonly assigned pending U.S. application Ser. No. 07/599,149, filed Oct. 17, 1990, in the name of Dwiggins et al, was developed to control the basis weight and formation. In this procedure, a controlled feed of fiber at a consistency of 0.5 to 7 wt% is introduced directly to an inlet of the fan pump and is thus mixed with foam to form a furnish having the desired consistency. The procedure of Dwiggins et al has been found to provide control over basis weight and formation. However, an increase in the amount of foam which must be treated in the surfactant recovery systems is produced in the procedure disclosed by Dwiggins et al.

SUMMARY OF THE INVENTION

The procedure of the present invention provides formation and basis weight control equivalent to that obtained with the Dwiggins et al procedure but avoids the overflow from the forming loop occasioned by the Dwiggins et al procedure, thus reducing the foam supplied to the surfactant recovery system. In the procedure of the present invention, conventional basis weight control apparatus is used to meter a controlled feed of pulp onto a belt press at a consistency of between about 0.5 and 7.0% fiber by weight. After passing through the belt press, a uniform unbroken strand of pulp having a consistency of between about 8 and 30% fiber by weight is conducted to a shearing mixing zone in a repulper, the mixing zone being substantially athwart the entire flow path leading from the belt press to the fan pump. In the mixing zone, the pulp is redispersed. The repulper and flow system leading from the belt press to the headbox are carefully configured to enable basis weight control means responsive to the basis weight of the formed web to modify the basis weight of the fiber provided to the headbox to be effectively controlled to maintain a uniform basis weight of the web having a coefficient of variation $C_v$ of less than about 3% and preferably less than 2% as measured on the paper machine using conventional basis weight measuring and control apparatus.

In the practice of the present invention, backmixing between the pulp thickener and the fan pump should be minimized. Ideally, pulp would pass "directly" from the thickener to the fan pump by plug flow, but as a practical matter at least some "mixing" volume is required to dilute the thickened pulp from a consistency in the neighborhood of 20% to the headbox consistency between about 0.2 and 0.8 wt% preferably between 0.3 and 0.5 wt%. The essential difference between a backmixing system and a plug flow system is best understood by comparing the response of each system to an impulse. The backmixing system exhibits a response approximating an exponential decay, while the plug flow system response approximates an impulse. Of course, neither system is ever encountered in its pure form in the real world and almost no flow system is capable of reproducing a pure impulse response, so the degree of approximation of any system to a plug flow system is expressed by measuring the decay time of the system with small decay times indicating a low degree of backmixing. Strictly speaking, the decay time is $\tau$ in the equation describing the response of the system:

$$R = R_o exp(-t/\tau);$$

where R is the system response and $R_o$ the maximum response at t=o. The decay time of real systems is usually considered to be the time required for the system response to fall to 1/e or 0.368 of its maximum value (at t=0), "e" being the base of Naperian logarithms. Alternatively, $\tau$ is estimated by plotting the logarithm of the system response against time, fitting a straight line thereto and calculating $\tau$ based thereupon. The preferred systems of the present invention will exhibit decay times of less than a minute and more preferably less than 45 seconds between the pulp thickener output and the takeup reel, it generally being impractical to measure responses between intermediate points. In still more preferred systems, the decay time will be under 30 seconds with the most preferred systems exhibiting a decay time of under 15 seconds. As the decay time is decreased while maintaining good mixing and fiber dispersion, basis weight control in this process is improved.

DESCRIPTION OF THE PREFERRED EMBODIMENTS

Figure 1:
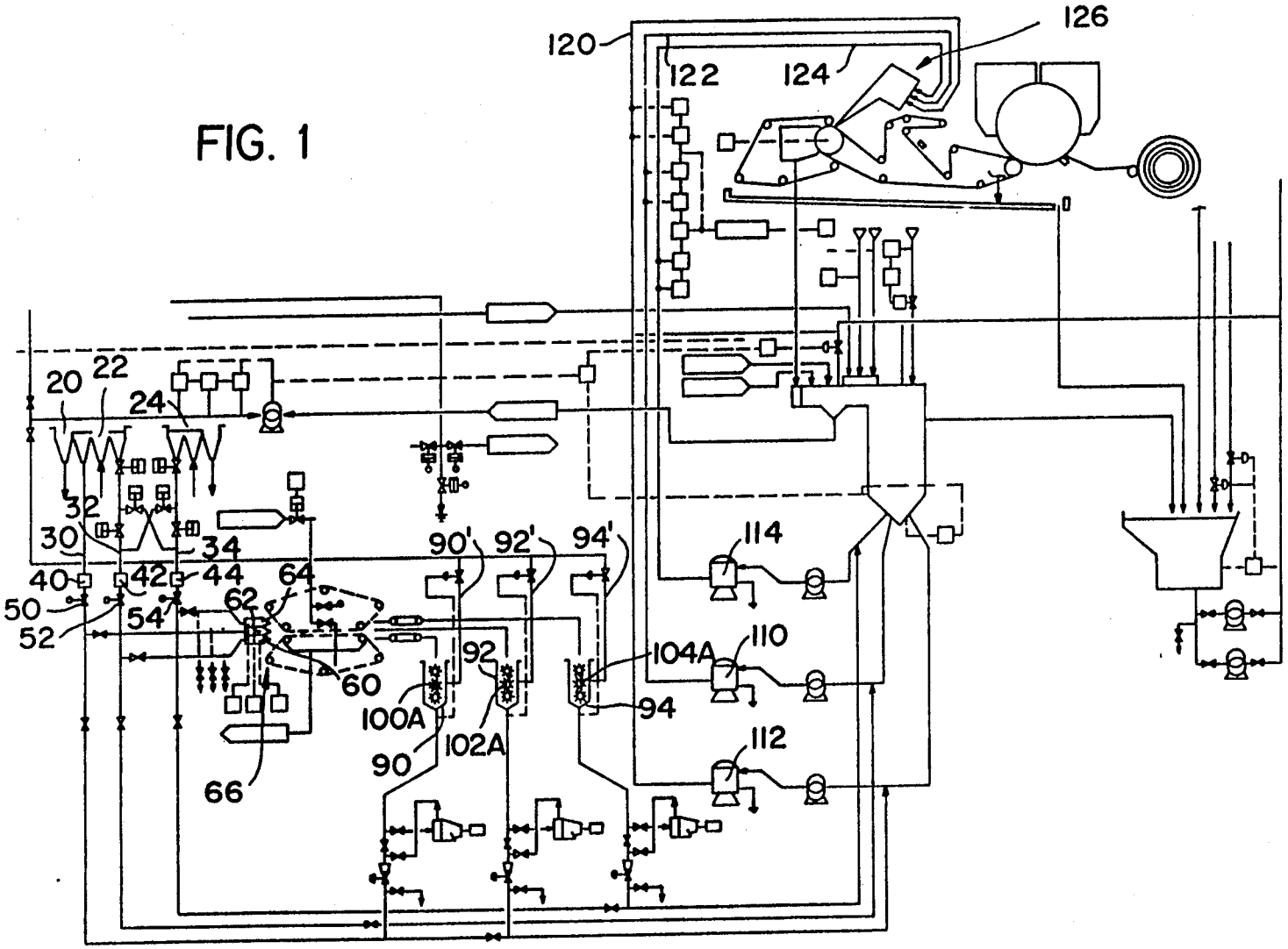
FIG. 1 is a schematic flow diagram outlining the overall flows of fiber, water and foam in the process of the present invention utilizing a multilayer headbox to produce a stratified product.

In FIG. 1, pulp slushes appropriate for the three separate layers of a stratified sheet of paper product are stored in stuff boxes 20, 22 and 24. Pulp exits from stuff boxes 20, 22, and 24 through conduits 30, 32 and 34, having consistency measuring devices 40, 42 and 44 and flow control valves 50, 52 and 54, respectively, contained therein.

Figure 2:
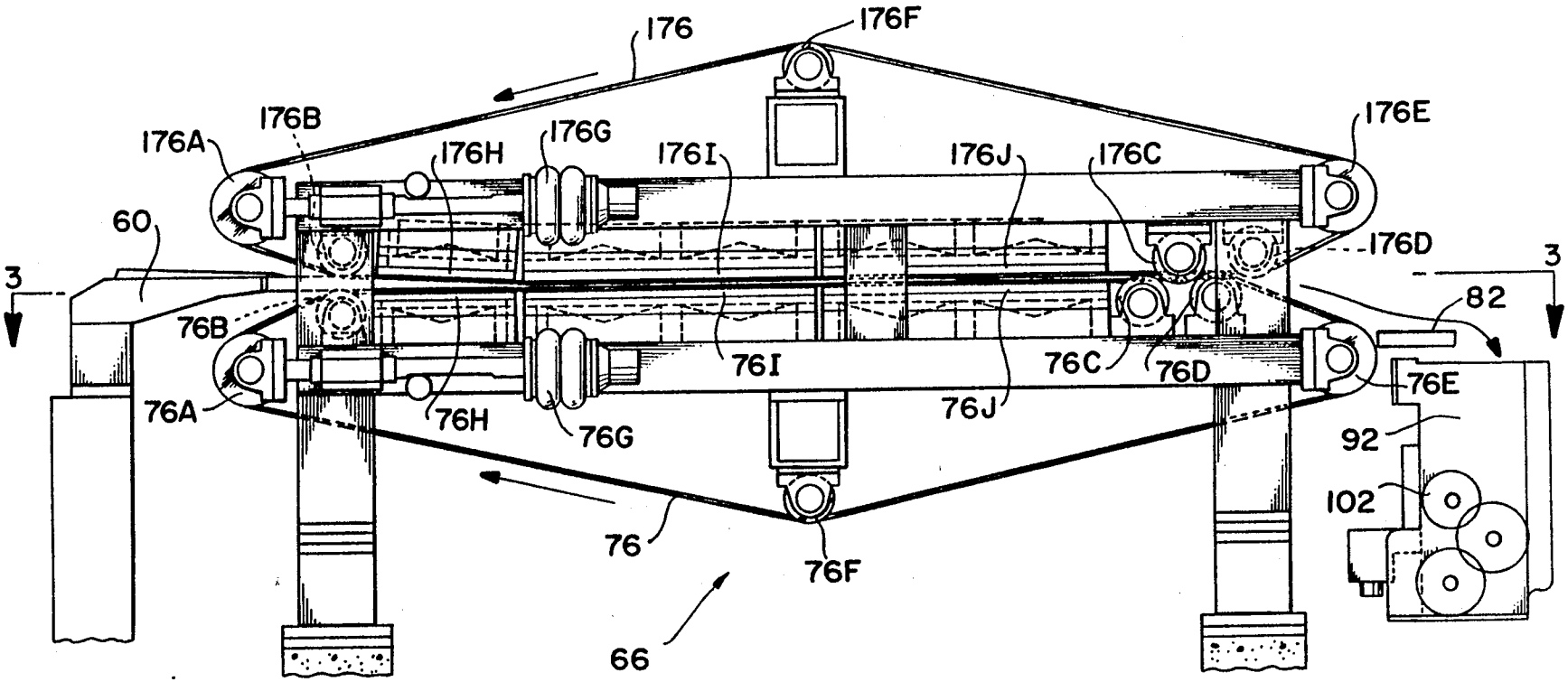
FIG. 2 is a side elevation of the pulp thickener and repulper illustrating the headbox, the press, the conveyors and a central repulper.
Figure 3:
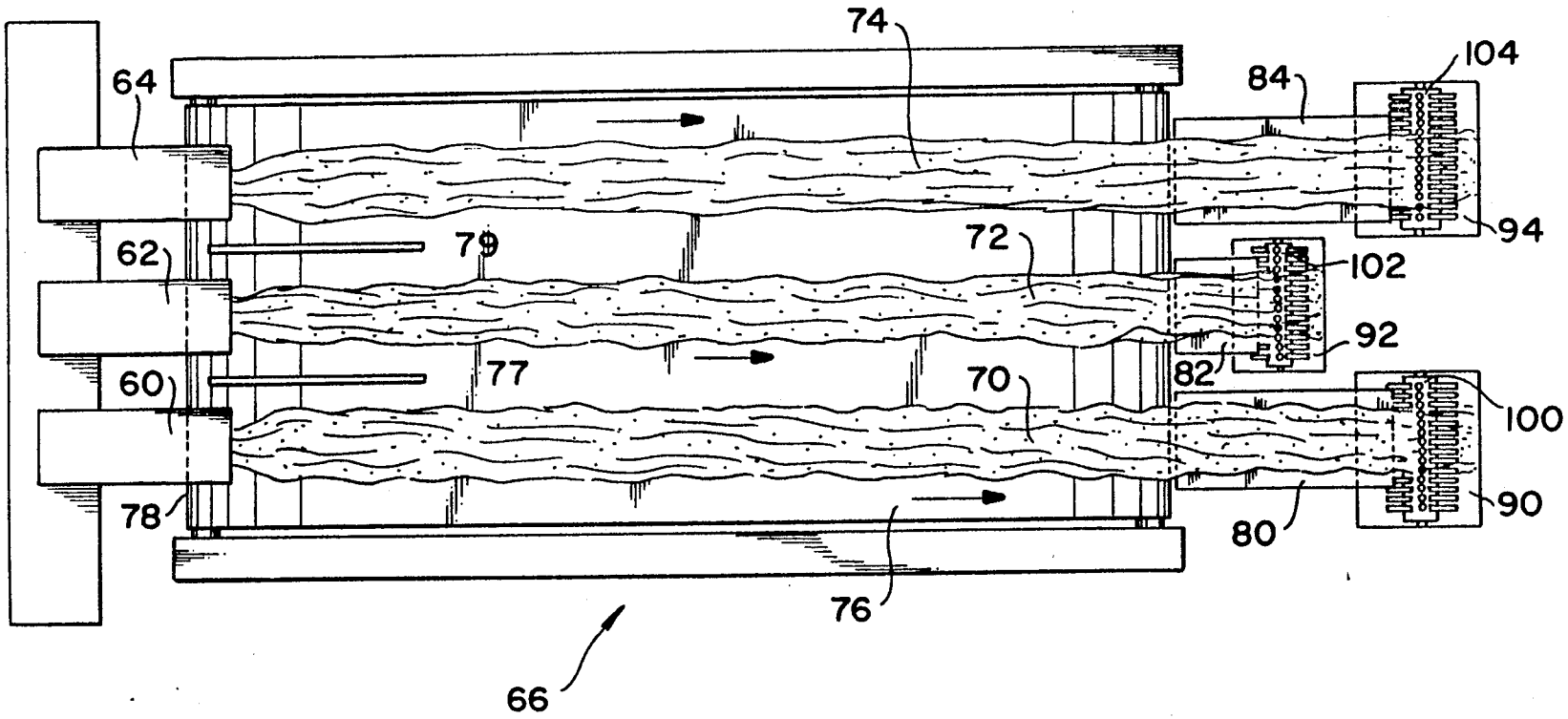
FIG. 3 is a sectional view along line 3—3 of FIG. 2 through the belt press used in the pulp thickener illustrating the three sections of the pulp thickener headbox, the dividers separating the sections of the belt used for each pulp strand and the conveyors used to conduct thickened pulp strands from the belt press to all the respective repulpers.
Figure 4:
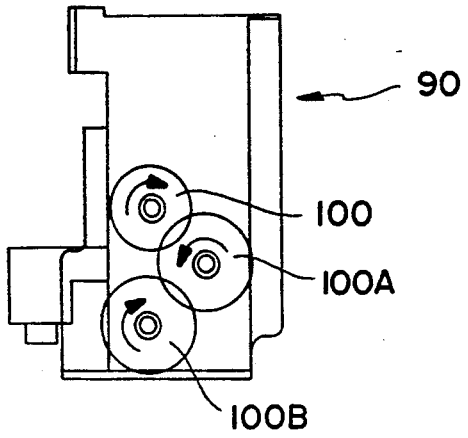
FIG. 4 is a schematic sectional end view of a repulper illustrating the pin mixer apparatus contained therein.
Figure 5:
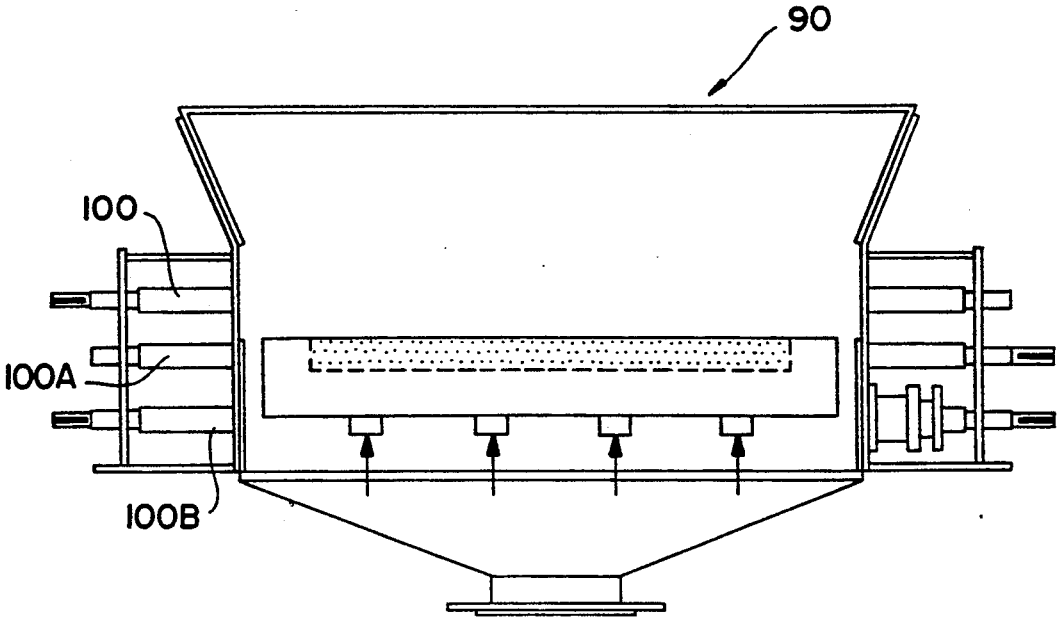
FIG. 5 is an elevation of a repulper illustrating the foam entry in relationship to the rolls of the pin mixer.
Figure 6:
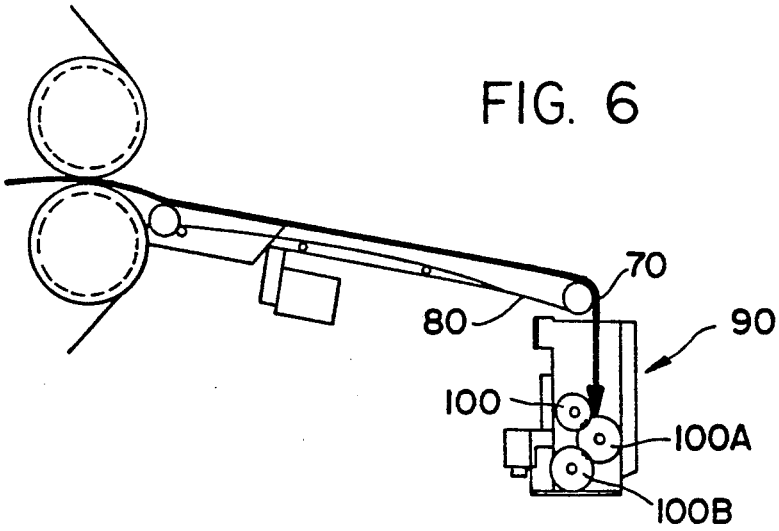
FIG. 6 is an end view of the conveyor apparatus used to conduct a continuous unbroken strand of pulp from the pulp thickener to the repulper, two such units being usable when a single belt press is used to thicken the fiber streams supplied to a triple layer stratified headbox.
Figure 7:
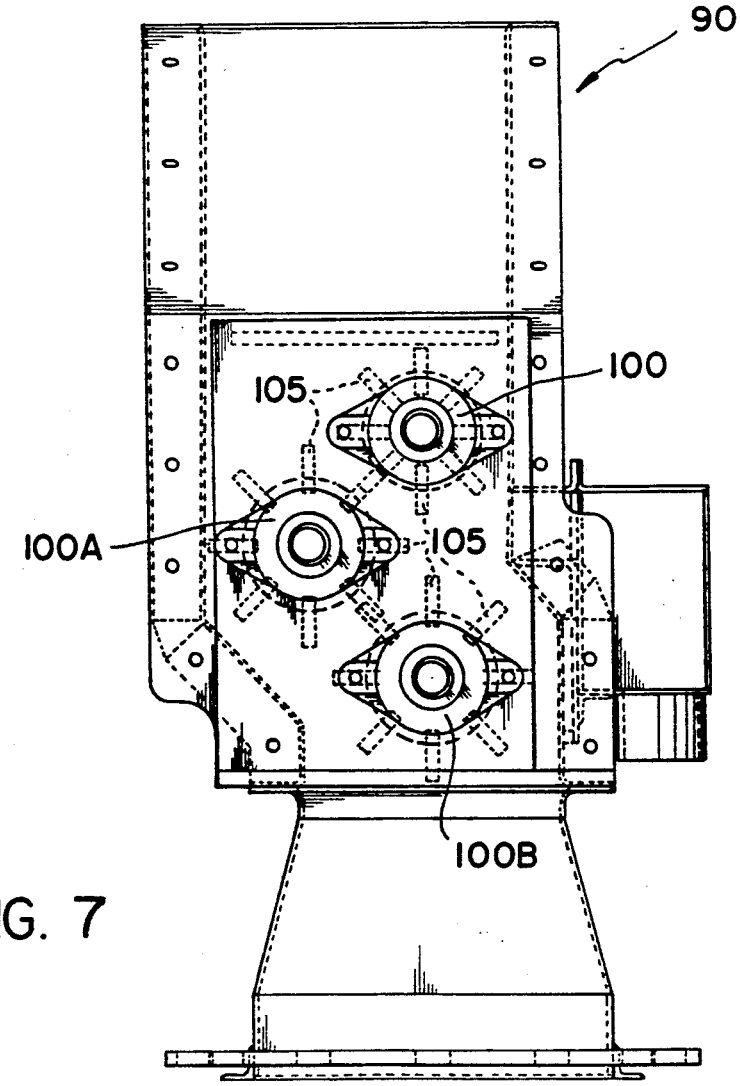
FIG. 7 is an enlarged view of FIG. 4 illustrating the intermeshing between the spines on each of the rolls in the pin mixers of each repulper as well as illustrating how the mixing zone created by the intermeshing of spines is substantially athwart the flow path through each repulper.
Figure 8:
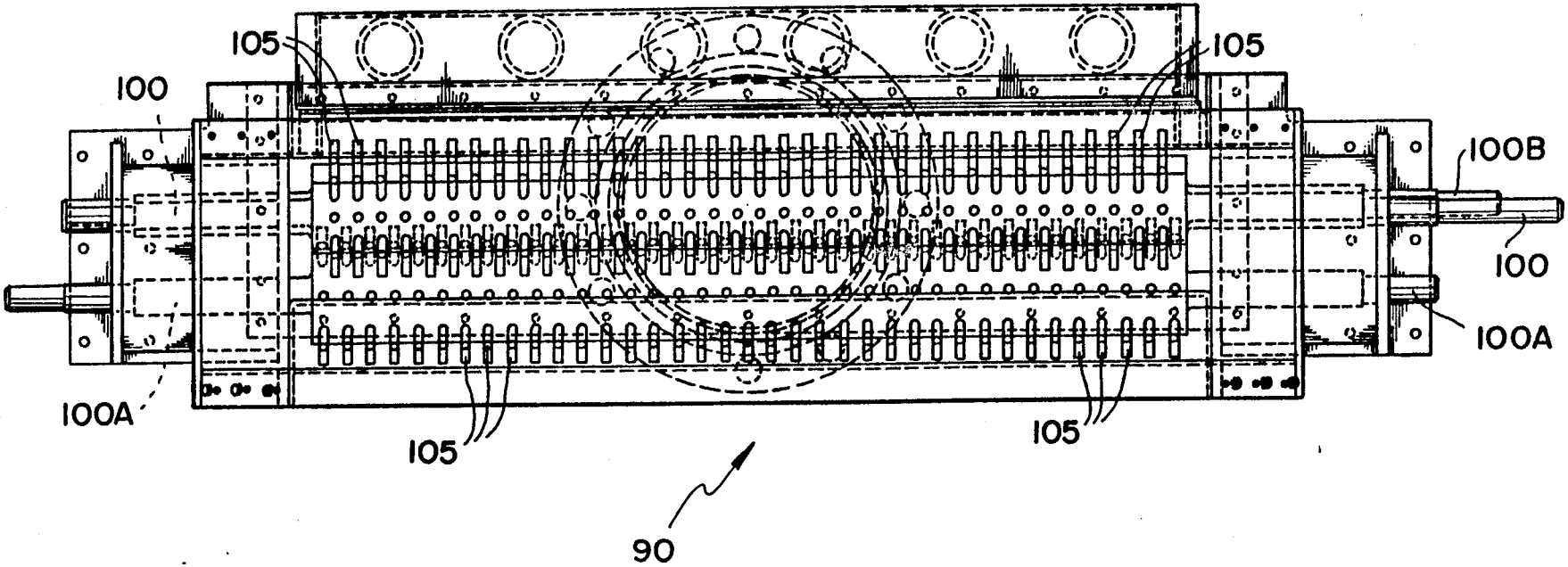
FIGS. 8 and 9 further illustrate the intermeshing of the spines on each roll of the pin mixer as well as illustrating that the mixing zone created thereby is substantially athwart the flow path through each repulper.
Figure 9:
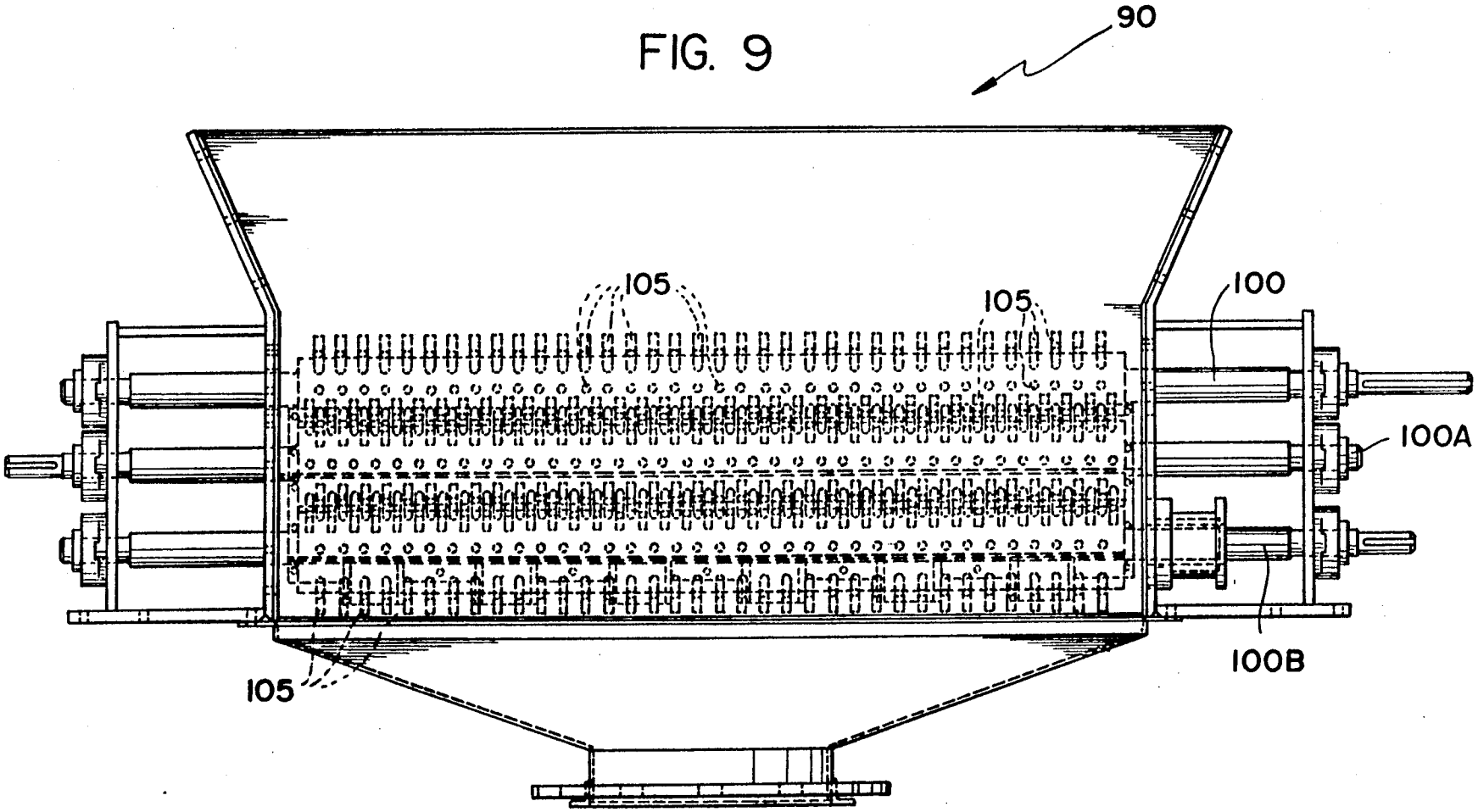

The conduits 30, 32 and 34 are operatively connected from stuff boxes 20, 22 and 24 to respective sections 60, 62 and 64 of pulp thickener headbox 66. As illustrated in FIGS. 1-3, pulp from each section 60, 62 and 64 of pulp thickener headbox 66 is deposited on sections 70, 72 and 74 of pulp thickener belt 76, sections 70, 72 and 74 are separated from each other at a leading edge 78 of pulp thickener belt 76 by dividers 77 and 79. The rate at which pulp in each of stuff boxes 20, 22, and 24 is conducted to belt 76 is maintained at a predetermined fiber addition rate by the action of the control valves 50, 52 and 54 as regulated by dual function measuring means 40, 42 and 44 which are of conventional construction and are capable of measuring flow rates as well as consistencies between 0.5 and 7.0 weight % with reasonable accuracy but are more accurate between 1 and 5 wt. % and are most accurate in the range of between about 2.5 and 4 wt. %. For the purpose of the present invention, we normally prefer to maintain the consistency in stuff boxes 20, 22 and 24 between about 2.5 to 3.5 wt. %. The flow through each of pulp thickener headbox sections 60, 62 and 64 is controlled by flow control valves 50, 52 and 54. In pulp thickener 66, as each stream of pulp is compressed between belts 76 and 176, the consistency of each pulp stream is increased to from about 8 to about 30 wt. %, and more preferably from about 15 to about 25 wt. % with a consistency of from about 20 to about 22 wt. % being most preferred.

As illustrated in FIG. 2, the belt 76 is guided for rotation around rolls 76A, 76B, 76C, 76D, 76E and 76F. The roll 76A is operatively connected to an adjustment mechanism 76G for maintaining the tension on the belt 76. Similarly, the belt 176 is guided for rotation around rolls 176A, 176B, 176C, 176D, 176E and 176F. The roll 176A is operatively connected to an adjustment mechanism 176G for maintaining the tension on the belt 176. Guide plates 76H, 76I and 76J support the travel of the belt 76 through the pulp thickener 66. Similarly, guide plates 176H, 176I and 176J support the travel of the belt 176 through the pulp thickener 66.

Pulp streams leaving the two outermost sections 70 and 74 of pulp thickener 66 are directed in unbroken continuous strands to conveyors 80 and 84 leading to repulpers 90 and 94. The belt speed of each conveyor 80 and 84 being carefully matched to the speed of belt 76 of pulp thickener 66 to ensure the integrity and continuity of each strand of pulp. The pulp stream leaving center portion 72 of belt 76 is directed in an unbroken continuous strand to repulper 92.

As illustrated in FIGS. 3-9, pin mixers 100, 102 and 104 are disposed in repulpers 90, 92 and 94, respectively. Each repulper 90, 92 and 94 includes a top roll and two bottom rolls. As illustrated in FIGS. 4-9, for purpose of explanation, reference will be directed to repulper 90 which includes a top roll 100 and two lower rolls 100A and 100B each having a plurality of intermeshing spines 105 projecting therefrom. Each roll 100, 100A and 100B extends across the width of its respective repulper and the staggered configuration of the intermeshing rolls ensures that the mixing zone thereby created is substantially athwart the flow path through each repulper. Each intermeshing roll is independently driven so that the rotational speed thereof may be controlled independently. The speed of the top roll in each repulper being closely matched to the speed of belt 76 to ensure that each strand of pulp enters each repulper in a continuous uniform unbroken condition. In some cases, the linear speed of the outermost portions of the spines of the top roll will be slightly more than speed of belt 76. In other cases, it may be slightly less, but in all cases the difference between the two speeds will not be so great as to compromise the integrity of the strand as it leaves the belt, traverses or bridges the intervening gap and enters the repulper. The rotational speeds of the bottom two rolls 100A an 100B are normally at higher speeds relative to the top roll 100 to ensure through mixing and redispersion of the pulp supplied to the repulper.

As illustrated in FIG. 1, in each repulper, foam is introduced through conduits 90', 92' and 94' at approximately the level of a second roll 100A, 102A and 104A of the repulpers 90, 92 and 94 and is maintained at a maximum level above the uppermost portion of the top roll 100, 102 and 104 of the repulpers 90, 92 and 94. The dispersion of pulp and fiber leaving each repulper 90, 92 and 94 is mixed with recycle foam from silo 108 at the entry of fan pump 110, 112 and 114 supplying each section 120, 122 and 124 of headbox 126.

The natures of the upper and lower belts 76 and 176 respectively used in pulp thickener 66, should be chosen to ensure that neither becomes clogged with fiber fines during operation.

ESTIMATION OF SYSTEM DECAY TIME $\tau$

This Example illustrates the measurement of the decay time of a system of the present invention.

Figure 10:
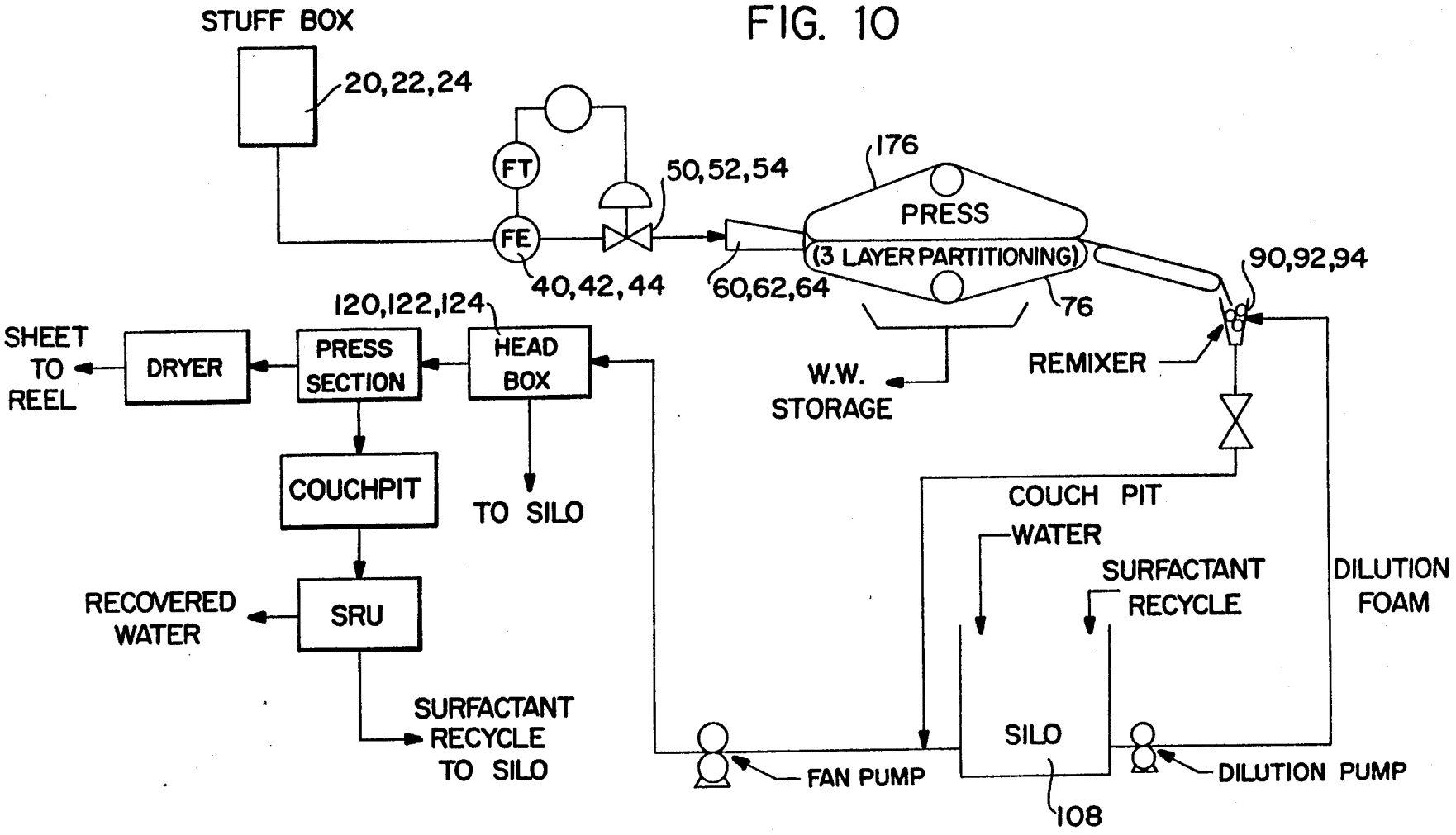
FIG. 10 is a schematic flow diagram illustrating the basis weight control apparatus, pulp thickening, repulping and dilution of a single stream of fiber as utilized in the practice of the present invention.
Figure 11:
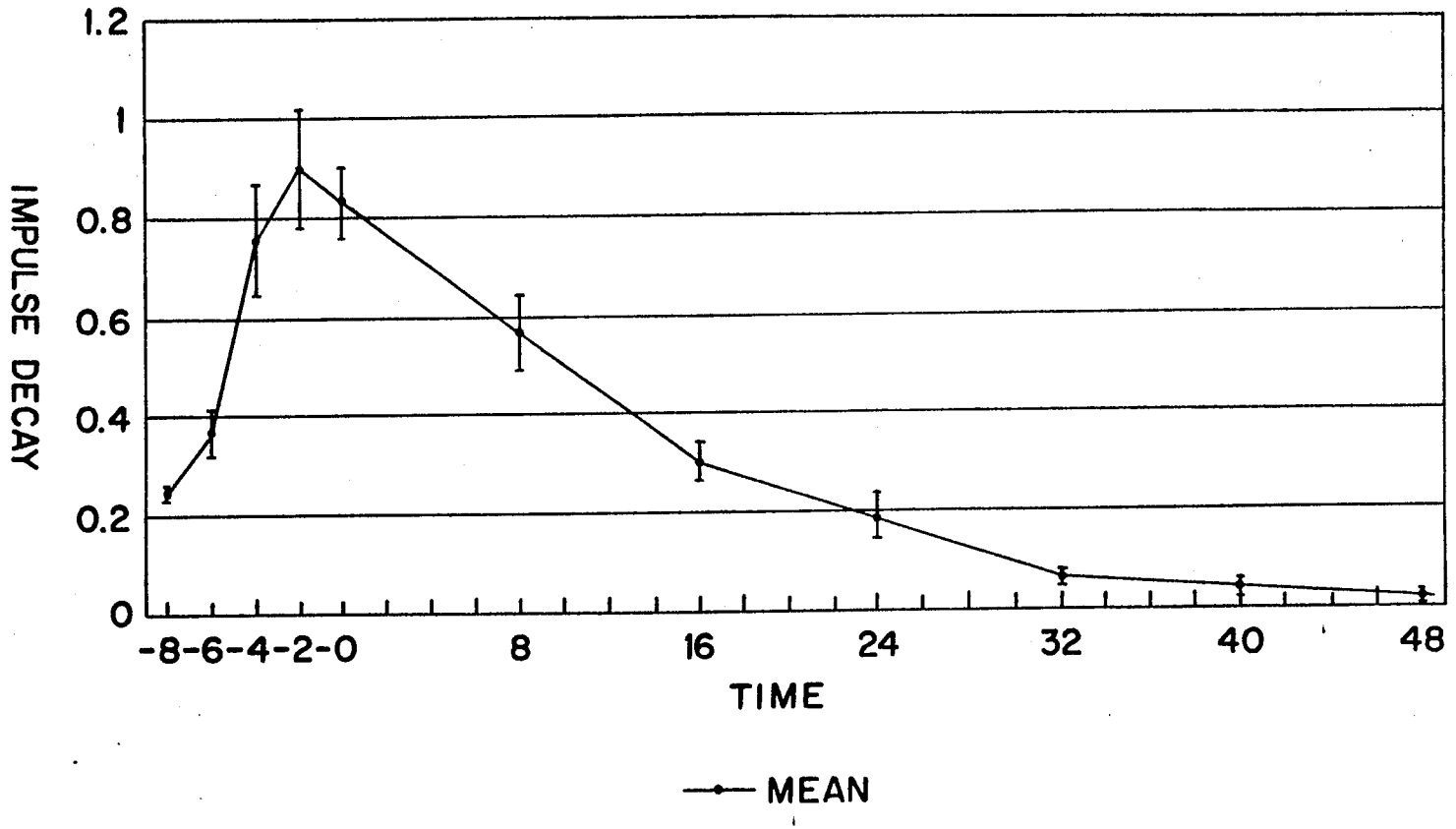
FIG. 11 illustrates the impulse response of a portion of a system, from the repulper to the takeup reel, which is suitable in the practice of the present invention.

A pilot scale system configured as described in FIG. 10 in which a conventional pulp of 50% HWK:50% SWK at a consistency of about 2.5–3% is introduced into the pulp thickener at a rate of 12 tons per 24 hr. day, is thickened to a consistency of approximately 22%, is mixed in the pin mixer with foam at an air content of about 60% maintained at a constant level above the upper pin roll; and is further diluted with additional foam to produce a consistency of around about 0.3% by weight in foam having an air content of about 68% as it passes through the fan pump and thence to the headbox. When stable operation was achieved, it was noted that it was extremely easy to maintain air content at the desired level. To measure the system decay time, a roll of colored bathroom tissue was slushed by vigorously stirring the tissue into about 1 gal. of water, the slush was dumped quickly into the pin mixer and the tissue formed collected. It was found that color first appeared in the tissue produced after about 36 sec. Samples were removed from sections of the resulting roll of tissue corresponding to the times (relative to the visually perceived peak intensity) indicated in Table 1. Image analysis conducted on three portions of each of these samples yielded the relative system response on a linear scale as set forth in Table 1. From the response curve (FIG. 11), it appeared that the decay time of the system was approximately 12 seconds, whether estimated by plotting the logarithm of response against time or by merely noting the time required for response to fall to 37% of peak.

Tissue of commercially salable quality, exhibiting a Kajaani Formation Index of 94.5 can be produced for extended periods of time without breaks and with a basis weight $C_v$ of less than 2.35%. Repeated trials with systems similar to those described in the Eber et al Patent in which the decay time of the repulping or mix tank alone exceeded 3 minutes failed to produce tissue having commercially salable quality.

TABLE 1

The results of image analysis of tissues collected at the below-identified time intervals follows. For each time, three successive sheets were sampled. Each sample involved the analysis of an area covering roughly 120 square cm.

| SAMPLE ID | TIME | % AREA | MEAN | SIGMA |
|---|---|---|---|---|
| 1 | −8 | 0.275 | 0.242 | 0.033 |
| | | 0.210 | | |
| | | 0.241 | | |
| 2 | −6 | 0.326 | 0.363 | 0.098 |
| | | 0.474 | | |
| | | 0.289 | | |
| 3 | −4 | 0.809 | 0.754 | 0.225 |
| | | 0.507 | | |
| | | 0.946 | | |
| 4 | −2 | 0.847 | 0.898 | 0.240 |
| | | 0.688 | | |
| | | 1.160 | | |
| 5 | 0 | 0.934 | 0.828 | 0.144 |
| | | 0.664 | | |
| | | 0.885 | | |
| 6 | 8 | 0.465 | 0.565 | 0.150 |
| | | 0.738 | | |
| | | 0.493 | | |
| 7 | 16 | 0.334 | 0.298 | 0.071 |
| | | 0.216 | | |
| | | 0.343 | | |
| 8 | 24 | 0.105 | 0.185 | 0.090 |
| | | 0.168 | | |
| | | 0.282 | | |
| 9 | 32 | 0.047 | 0.063 | 0.014 |
| | | 0.069 | | |
| | | 0.074 | | |
| 10 | 40 | 0.018 | 0.040 | 0.025 |
| | | 0.067 | | |
| | | 0.036 | | |
| 11 | 48 | 0.014 | 0.019 | 0.005 |
| | | 0.018 | | |
| | | 0.024 | | |

We claim:

1. A method of foam forming of paper, comprising the steps of:

(a) metering a controlled feed of fiber dispersed in an aqueous liquid into a dewatering device, the consistency of the fiber dispersed in said aqueous liquid input to the dewatering device being between about 0.5 and about 7% by weight;

(b) obtaining, from said dewatering device, a uniform continuous strand of semi-moist pulp, the consistency of the semi-moist pulp leaving the dewatering device being between about 8 and 30% by weight;

(c) obtaining a stream of a foamed aqueous admixture;

(d) introducing said foamed aqueous stream and said semi-moist pulp into a dispersing mixer having shearing action extending substantially throughout a zone substantially athwart the flow path of said uniform continuous strand and said foamed aqueous stream and forming a stream of dispersed fiber bearing aqueous foam;

(e) conducting said dispersed fiber bearing aqueous stream to the inlet of a positive displacement pump; and (f) thereafter conducting said dispersed fiber bearing stream through a headbox and depositing the fibers dispersed in said stream on a moving foraminous support.

2. The method of foam forming of paper as set forth in claim 1, wherein the consistency of the fibers dispersed in the aqueous liquid input to the dewatering device is between about 1 to about 5% by weight.

3. The method of foam forming of paper as set forth in claim wherein the consistency of the fibers dispersed in the aqueous liquid input to the dewatering device is between about 2.5 to about 4% by weight.

4. The method of foam forming of paper as set forth in claim 1, wherein the consistency of the semi-moist pulp leaving the dewatering device is between about 15 to about 30% by weight.

5. The method of foam forming of paper as set forth in claim 1, wherein the consistency of the semi-moist pulp leaving the dewatering device is between about 18 to about 25% by weight.

6. A method of foam forming of paper, comprising the steps of:

(a) metering a controlled feed of fiber dispersed in aqueous liquid into a dewatering device, the consistency of the fiber dispersed in aqueous liquid input to the dewatering device being between about 0.5 and about 7% by weight;

(b) obtaining, from said dewatering device, a uniform continuous flux of semi-moist pulp, the consistency of the semi-moist pulp leaving the dewatering device being between about 8 and 30% by weight;

(c) obtaining a stream of a foamed aqueous admixture;

(d) introducing said foamed aqueous stream and said uniform continuous flux of semi-moist pulp into a dispersing mixer having shearing action extending substantially throughout a zone substantially athwart the flow path of said semi-moist pulp and said foamed aqueous stream and forming a stream of dispersed fiber bearing aqueous foam;

(e) conducting said dispersed fiber bearing aqueous stream to the inlet of a positive displacement pump;

(f) thereafter conducting said dispersed fiber bearing stream through a headbox and depositing the fibers dispersed in said stream on a moving foraminous support forming a fibrous web; and (g) measuring the basis weight of said fibrous web and controlling the rate at which fiber is introduced in the controlled feed of said dispersion of fiber in aqueous liquid into said dewatering device to maintain a uniform basis weight of said fibrous web.

7. The method of foam forming of paper as set forth in claim 6, wherein the consistency of the fibers dispersed in the aqueous liquid input to the dewatering device is between about 1 to about 5% by weight.

8. The method of foam forming of paper as set forth in claim 6, wherein the consistency of the fibers dispersed in the aqueous liquid input to the dewatering device is between about 2.5 to about 4% by weight.

9. The method of foam forming of paper as set forth in claim 6, wherein the consistency of the semi-moist pulp leaving the dewatering device is between about 15 to about 30% by weight.

10. The method of foam forming of paper as set forth in claim 6, wherein the consistency of the semi-moist pulp leaving the dewatering device is between about 18 to about 25% by weight.

11. A method of foam forming of paper, comprising the steps of:

(a) providing a stream of fiber dispersed in aqueous liquid;

(b) measuring the consistency of said stream of fiber dispersed in aqueous liquid;

(c) metering a controlled feed of said stream of said fiber dispersed in aqueous liquid into a dewatering device, the consistency of the fiber dispersed in aqueous liquid input to the dewatering device being maintained between about 0.5 and about 7% by weight;

(d) obtaining, from said dewatering device, a flux of semi-moist pulp, the consistency of the semi-moist pulp leaving the dewatering device being between about 8 and 30% by weight;

(e) obtaining a stream of a foamed aqueous admixture;

(f) contacting said flux of semi-moist pulp with said foamed aqueous stream and thereafter conducting said flux of semi-moist pulp contacted with said foamed aqueous stream directly and with minimal backmixing through a dispersing mixer having shearing action extending substantially throughout a zone substantially athwart said foamed aqueous stream forming a stream of dispersed fiber bearing aqueous foam;

(g) conducting said stream of dispersed fiber bearing aqueous foam directly and with minimal backmixing to the inlet of a positive displacement pump;

(h) thereafter conducting said stream of dispersed fiber bearing foam through a headbox and depositing the fibers dispersed in said stream on a moving foraminous support forming a fibrous web;

(i) measuring the basis weight of said fibrous web and controlling the rate at which said semi-moist pulp enters said dispersing mixer, as well as the degree of backmixing, to maintain both a uniform controlled feed of fiber and a uniform basis weight of said fibrous web, the coefficient of variation of basis weight of said web, $C_v$, being less than about 3%.

12. The method of foam forming of paper as set forth in claim 11, wherein the consistency of the fibers dispersed in the aqueous liquid input to the dewatering device is between about 1 to about 5% by weight.

13. The method of foam forming of paper as set forth in claim 11, wherein the consistency of the fibers dispersed in the aqueous liquid input to the dewatering device is between about 2.5 to about 4% by weight.

14. The method of foam forming of paper as set forth in claim 11, wherein the consistency of the semi-moist pulp leaving the dewatering device is between about 15 to about 30% by weight.

15. The method of foam forming of paper as set forth in claim 11, wherein the consistency of the semi-moist pulp leaving the dewatering device is between about 18 to about 25% by weight.

16. The method of foam forming of paper as set forth in claim 11, wherein the coefficient of variation of basis weight of the web, $C_v$, is less than about 2%.

17. A method of foam forming of paper, comprising the steps of:

(a) metering a controlled feed of fiber dispersed in aqueous liquid into a dewatering device, the consistency of the dispersion of fiber in aqueous liquid input to the dewatering device being between about 0.5 and about 7% by weight;

(b) obtaining, from said dewatering device, a uniform continuous flux of semi-moist pulp, the consistency of the semi-moist pulp leaving the dewatering device being between about 8 and 30% by weight;

(c) obtaining a stream of a foamed aqueous admixture;

(d) introducing said foamed aqueous stream and said uniform continuous flux of semi-moist pulp into a repulping mixer having a residence time of less than about 10 seconds and shearing action extending substantially throughout a zone substantially athwart the combined flow path of said flux of pulp and said foamed aqueous stream and forming a stream of dispersed fiber bearing aqueous foam;

(e) conducting said dispersed fiber bearing aqueous stream directly to the inlet of a positive displacement pump through a first conduit having a decay time of less than 10 seconds;

(f) thereafter conducting said dispersed fiber bearing stream through a second conduit having a decay time of less than 15 seconds to a headbox and depositing the fibers dispersed in said stream on a moving foraminous support forming a fibrous web;

(g) measuring the basis weight of said fibrous web and controlling the rate at which fiber is introduced in the controlled feed of said dispersion of fiber in aqueous liquid into said dewatering device to maintain a uniform basis weight of said fibrous web.

18. The method of foam forming of paper as set forth in claim 17, wherein the consistency of the fibers dispersed in the aqueous liquid input to the dewatering device is between about 1 to about 5% by weight.

19. The method of foam forming of paper as set forth in claim 17, wherein the consistency of the fibers dispersed in the aqueous liquid input to the dewatering device is between about 2.5 to about 4% by weight.

20. The method of foam forming of paper as set forth in claim 17, wherein the consistency of the semi-moist pulp leaving the dewatering device is between about 15 to about 30% by weight.

21. The method of foam forming of paper as set forth in claim 17, wherein the consistency of the semi-moist pulp leaving the dewatering device is between about 18 to about 25% by weight.

22. A method of foam forming of paper, comprising the steps of:

(a) providing a stream of fiber dispersed in aqueous liquid;

(b) measuring the consistency of said stream of fiber dispersed in aqueous liquid;

(c) metering a controlled feed of said stream of said fiber dispersed in aqueous liquid into a dewatering device, the consistency of the fiber dispersed in aqueous liquid input to the dewatering device being maintained between about 0.5 and about 7% by weight;

(d) obtaining, from said dewatering device, a flux of semi-moist pulp, the consistency of the semi-moist pulp leaving the dewatering device being between about 8 and 30% by weight;

(e) obtaining a stream of a foamed aqueous admixture;

(f) contacting said flux of semi-moist pulp with said foamed aqueous stream and thereafter conducting said flux of semi-moist pulp contacted with said foamed aqueous stream directly and with minimal backmixing through a dispersing mixer having shearing action extending substantially throughout a zone substantially athwart said foamed aqueous stream forming a stream of dispersed fiber bearing aqueous foam;

(g) conducting said stream of dispersed fiber bearing aqueous foam directly and with minimal backmixing to the inlet of a positive displacement pump;

(h) thereafter conducting said stream of dispersed fiber bearing foam through a headbox and depositing the fibers dispersed in said stream on a moving foraminous support forming a fibrous web; and (i) measuring the basis weight of said fibrous web and controlling the rate at which said semi-moist pulp enters said dispersing mixer, as well as the degree of backmixing, to maintain both a uniform controlled feed of fiber and a uniform basis weight of said fibrous web, the coefficient of variation of basis weight of said web, $C_v$, being less than about 3%.

23. The method of foam forming of paper as set forth in claim 22, wherein the consistency of the fibers dispersed in the aqueous liquid input to the dewatering device is between about 1 to about 5% by weight.

24. The method of foam forming of paper as set forth in claim 22, wherein the consistency of the fibers dispersed in the aqueous liquid input to the dewatering device is between about 2.5 to about 4% by weight.

25. The method of foam forming of paper as set forth in claim 22, wherein the consistency of the semi-moist pulp leaving the dewatering device is between about 15 to about 30% by weight.

26. The method of foam forming of paper as set forth in claim 22, wherein the consistency of the semi-moist pulp leaving the dewatering device is between about 18 to about 25% by weight.

27. The method of foam forming of paper as set forth in claim 22, wherein the coefficient of variation of basis weight of the web, $C_v$, is less than about 2%.

28. A method of foam forming of paper, comprising the steps of:

(a) providing a stream of fiber dispersed in aqueous liquid;

(b) measuring the consistency of said stream of fiber dispersed in aqueous liquid;

(c) metering a controlled feed of said stream of said fiber dispersed in aqueous liquid into a dewatering device, the consistency of the fiber dispersed in aqueous liquid input to the dewatering device being maintained between about 0.5 and about 7% by weight;

(d) obtaining, from said dewatering device, a flux of semi-moist pulp, the consistency of the semimoist pulp leaving the dewatering device being between about 8 and 30% by weight;

(e) obtaining a stream of a foamed aqueous admixture;

(f) contacting said flux of semi-moist pulp with said foamed aqueous stream and thereafter conducting said flux of semi-moist pulp contacted with said foamed aqueous stream directly and with minimal backmixing through a dispersing mixer having shearing action extending substantially throughout a zone substantially athwart said foamed aqueous stream forming a stream of dispersed fiber bearing aqueous foam;

(g) conducting said stream of dispersed fiber bearing aqueous foam through a low backmixing piping system directly to the inlet of a positive displacement pump, the decay time, $\tau$, of said dispersing mixer and low backmixing piping system being less than about 30 seconds;

(h) thereafter conducting said stream of dispersed fiber bearing foam through a headbox and depositing the fibers dispersed in said stream on a moving foraminous support forming a fibrous web; and (i) measuring the basis weight of said fibrous web and controlling the rate at which said semi-moist pulp enters said dispersing mixer to maintain both a uniform controlled feed of fiber and a uniform basis weight of said fibrous web, the coefficient of variation of basis weight of said web $C_v$, being less than about 3%.

* * * * *